United States Patent [19]

Araki et al.

[11] 4,075,732

[45] Feb. 28, 1978

[54] CLEANING DEVICE APPLIED TO FLATS OF A REVOLVING FLAT CARD

[75] Inventors: Hidejiro Araki, Toyoake; Susumu Otani, Obu, both of Japan

[73] Assignee: Kabushiki Kaisha Toyoda Jidoshokki Seisakusho, Japan

[21] Appl. No.: 645,519

[22] Filed: Dec. 31, 1975

[30] Foreign Application Priority Data

Jan. 8, 1975 Japan ..... 50-4799

[51] Int. Cl.[2] ..... D01G 15/76

[52] U.S. Cl. ..... 15/301; 19/107

[58] Field of Search ..... 15/301; 19/107, 111

[56] References Cited

U.S. PATENT DOCUMENTS

| | | | |
|---|---|---|---|
| 3,375,555 | 4/1968 | Vinogradov et al. | 19/107 X |
| 3,438,093 | 4/1969 | Rutz | 19/107 |

FOREIGN PATENT DOCUMENTS

| | | | |
|---|---|---|---|
| 1,407,594 | 6/1965 | France | 15/301 |
| 1,510,227 | 10/1971 | Germany | 15/301 |
| 672,426 | 10/1964 | Italy | 19/107 |
| 578,571 | 7/1946 | United Kingdom | 19/113 |

*Primary Examiner*—Christopher K. Moore

*Attorney, Agent, or Firm*—Burgess, Ryan and Wayne

[57] ABSTRACT

Cleaning device for preventing discharge of fly from a card into the atmosphere of a carding room by an air stream emerging from spaces between a plurality of flat bars. A resilient sealing member is disposed in each space between two adjacent flat bars in such a manner that two free side portions of the resilient sealing member are always urged against to each rib of the above-mentioned two adjacent flat bars. Each sealing member is held by a link member of the link chains which carry the flat bars, each flat bar riding on two spaced curved bars. A cover plate is rigidly mounted on each curved bar in such a way that the cover forms a duct with the above-mentioned flat bars moving along the working passage facing the cylindrical surface of the main cylinder of the card and with the above-mentioned resilient sealing members. Consequently such ducts are formed at the two sides of the card. At least one discharge pipe is connected to each duct so as to discharge the aforementioned fly from the card.

7 Claims, 12 Drawing Figures

CLEANING DEVICE APPLIED TO FLATS OF A REVOLVING FLAT CARD

BACKGROUND OF THE INVENTION

The present invention relates to a cleaning device applied to flats of a conventional revolving flat card, more particularly it relates to a cleaning device for preventing discharge of short fibers or dust from the card into the atmosphere of the carding room by an air stream discharged from spaces between a plurality of flat bars.

To prevent the aforementioned discharge of short fibers or dust, several devices have been developed. One of these is disclosed in the Japanese patent publication Sho 40 (1965) — 26214, wherein the revolving flats are completely covered with a cover so as to form a sealed enclosure. Air is then blown into the sealed enclosure from one side thereof and is discharged from the other side of the sealed enclosure by a suction air stream so that short fibers and dust, which are blown off through spaces between each two adjacent flat bars, are discharged by the above-mentioned suction air stream. However, this device is not practical because a very large cover is necessary to cover the entire space occupied by the flats and, further, additional elements such as a powerful suction blower and a filter means, etc., are necessary. Consequently, the device becomes large and the construction thereof becomes complicated so that the installation cost is inevitably increased.

A simple device for a purpose similar to that of the aforementioned device is disclosed in the Japanese Utility Model publication Sho 48 (1973) — 38117. In this device a sealing plate provided with an elastic plate secured to a side surface thereof is disposed on each flat bar so as to close each space between two adjacent flat bars for preventing the free discharge of an air stream containing short fibers and dust from the aforementioned space. However, in this case, since the sealing plate is mounted on back skin portion of the flat bar, it is very difficult to rigidly mount the sealing plate on the flat bar and such mounting of the sealing plate is very complicated and difficult. Further, if the flat bars are provided with a particular shape, it is possible that perfect covering of the free space between two adjacent flat bars by the sealing plate, at the working position of these flats, becomes impossible. Further, when it is necessary to grind the wires of the flats, or to change the used wires of the flats to new ones, the sealing plate must be removed from each flat bar.

The Japanese Utility Model publication Sho 49 (1974) — 15215 discloses another new device to for a purpose similar to that of the above-mentioned prior art publications. In this device, a sealing member is disposed in the space between adjacent flat bars so as to seal the aforementioned space. However, the sealing member is mounted on the respective flats and, therefore, such sealng member disturbs free handling of the respective flats. When the used flats are replaced by fresh ones, the sealing member must be separated from the corresponding flat bars. Further, when grinding of the wires is necessary to shape the wires, the sealing members must be separated fromm their respective flat bars. In this device, it is impossible to cover the aforementioned spaces entirely so as to seal portions of each space at both sides of the flat bar in a perfect sealed condition. As a result the air stream containing short fibers and dust is blown out of the aforementioned side portions of each space.

The principal purpose of the present invention is to provide a cleaning device for preventing free discharge of short fibers or dust from the spaces between adjacent flat bars of a conventional revolving flat card into the atmosphere of the carding room, whereby the problems mentioned above with regard to the prior art cleaning devices may be solved.

SUMMARY OF THE INVENTION

In the device according to the present invention, an elastic sealing member is disposed in a space formed by each two adjacent flat bars in such a manner that the sealing member contacts corresponding side walls of back rims of two adjacent flat bars, which extend toward the axial direction of the main cylinder. A cover plate is disposed at a curved surface defined by the path of the back rim of each flat bar as said bar moves along a working path facing a main cylinder of the card. The cover plate is provided with a pair of inner side plates which seal open spaces formed at both lateral sides of the aforementioned elastic sealing members and also is provided with a pair of outer side plates which seal both sides of the carrying passage of the flats being displaced along the aforementioned working position. Thus a pair of curved air ducts are formed at both edge portions of the main cylinder by the aforementioned cover plate provided with the inner side and outer side plates and the sealing members, respectively.

A pair of discharging outlets are formed on the cover plate at symmetrical positions facing the aforementioned aid ducts and a pair of discharging pipes are connected to the corresponding discharging outlets. These discharging pipes are connected to a suction means and, therefore, short fibers and dust are effectively discharged from the spaces formed between each two adjacent flat bars by way of the aforementioned two curved air ducts to the suction means. Since the construction of the aformentioned device is very simple, the installation cost is very cheap. Further, any traditional operation, such as grinding the wires of the flats, changing used flats for new ones, etc., can be easily carried out. Consequently, the device according to the present invention is a very practical device to attain the purpose of the present invention.

DETAILED EXPLANATION OF THE INVENTION

Figure 1:
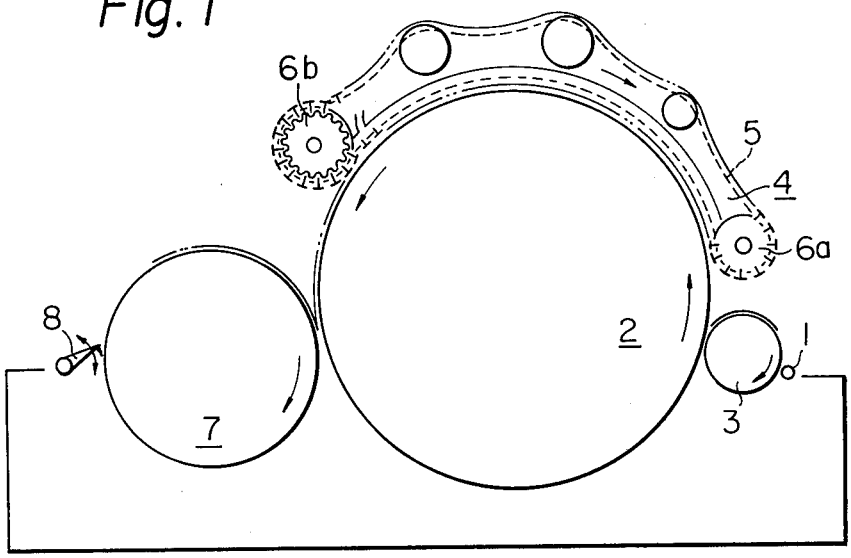
FIG. 1 is a schematic side view of a conventional revolving flat card.

Referring to FIG. 1, in the conventional revolving flat card, fibers supplied by a feed roller 1 are transferred onto a cylindrical carding surface of a main cylinder 2 via a takerin roller 3. These fibers are subjected to carding action while they are passing through the passage between the cylindrical carding surface of the main cylinder 2 and a plurality of flats 4, by the carding action created by the motion of (i) carding wires mounted on the aforementioned carding surface of the main cylinder 2 and (ii) wires mounted on each flat 4. Each of these flats comprises a flat bar, laterally extending along the axial direction of the main cylinder 2, with fillet wires or metallic wires mounted thereon. These flat bars are connected by a pair of link chains 5 at both ends thereof. A double pair of chain blocks 6*a* and 6*b* are mounted on respective horizontal shafts disposed above the main cylinder 2 so as to drive the above-mentioned link chains 5. The flats 4 are displaced along a portion of the cylindrical working surface of the main cylinder 2 in a direction shown in FIG. 1. The carded fibers are then transferred from the working surface of the main cylinder 2 to a doffer 7 and, thereafter, these carded fibers are taken off from the cylindrical working surface of the doffer 7 by an action of a fly comb 8 so as to strip these carded fibers in a web form. Then the web is discharged from the revolving flat card in the form of a sliver. In the above-mentioned conventional revolving flat card, the device according to the present invention is applied to the revolving flats 4 at a position where the flats 4 are displaced along the cylindrical working surface of the main cylinder 2 in facing condition.

Figure 2:
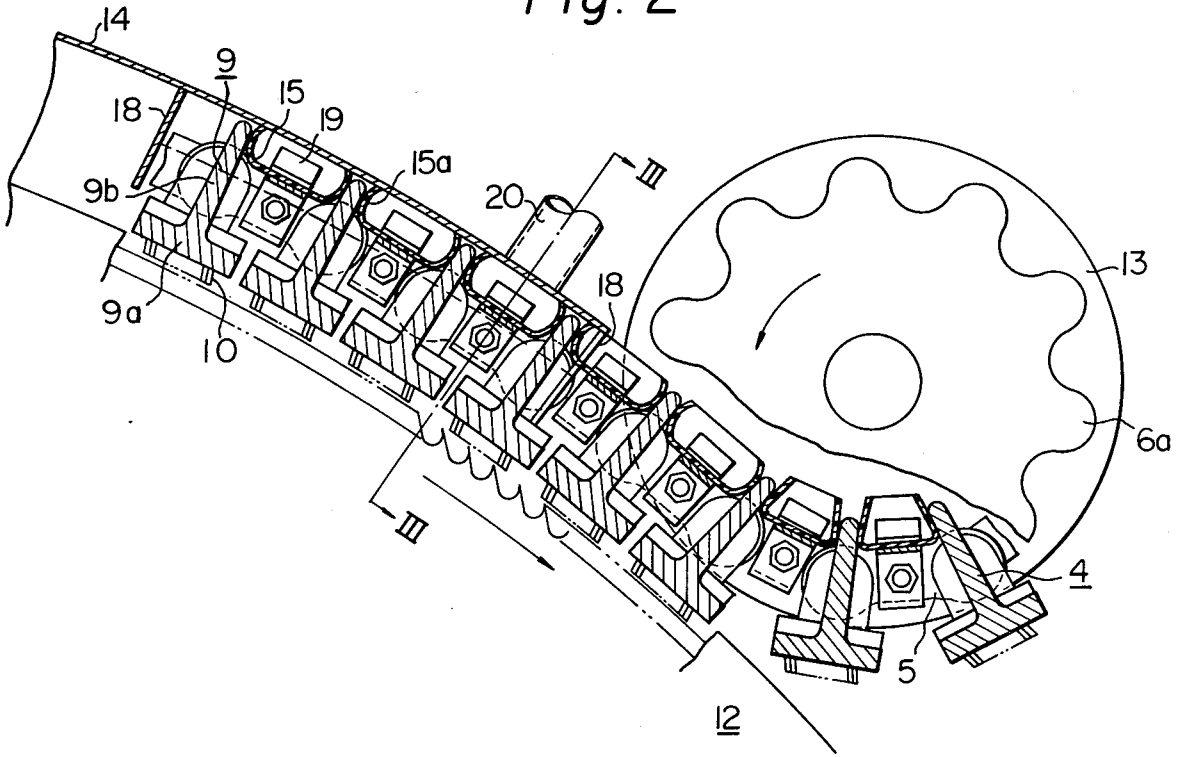
FIG. 2 is a side view of the cleaning device according to the present invention applied to the revolving flat card shown in FIG. 1.
Figure 3:
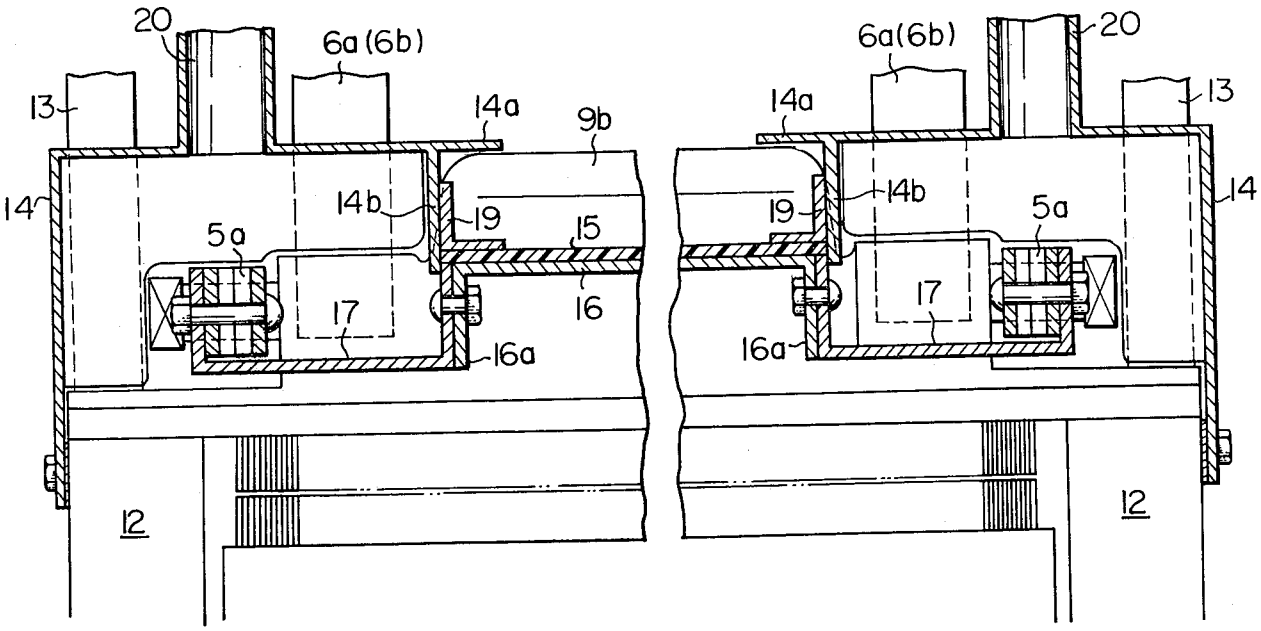
FIG. 3 is a cross-sectional view of the cleaning device, taken along III—III in FIG. 2.

An embodiment of the device according to the present invention is hereinafter explained in detail with reference to the attached drawings. Referring to FIGS. 2 and 3, each flat 4 comprises a flat bar 9 provided with a flat portion 9*a*, a rib 9*b* extended backward from the back surface of the flat portion 9*a* in an upright condition and carding fillet wires or metallic wires 10 mounted on the flat portion 9*a* of the flat bar 9. The flat bars 9 are connected at their two end portions by the pair of link chains 5 as shown in FIGS. 1 and 2. The endless flat assembly is driven by the chain block 6*a* in such a manner that each flat 4 slides along a pair of curved bars 12 which guide the two end portions of each flat bar 9. A pair of plain blocks 13 are mounted on both end portions of shafts utilized for supporting the chain blocks 6*a* and 6*b* so as to guide the two end sides of each flat bar 9. A pair of cover plates 14 are rigidly mounted on each of the curved bars 12 as hereinafter explained in detail. That is, each of the covers 14 occupies a space adjacently above the corresponding curved bar 12 in such a way that each end portion of each flat bar 9 is capable of being covered in the working position of the flats upon the main cylinder 2 by utilizing a flexible resilient sealing member 15 disposed at a position between two adjacent flats 4. As shown in FIG. 3, each resilient sealing member 15 is rigidly mounted on a horizontal supporting member 16 by a suitable fixing means such as bolts (not shown), and both end portions 16*a* are rigidly supported by a pair of link elements 5*a* of the link chains 5, which face each other, by way of a corresponding intermediate block 17. That is, the resilient sealing member 15 is rigidly held on the supporting member 16 at a middle position between two adjacent flat bars 9.

Figure 5:
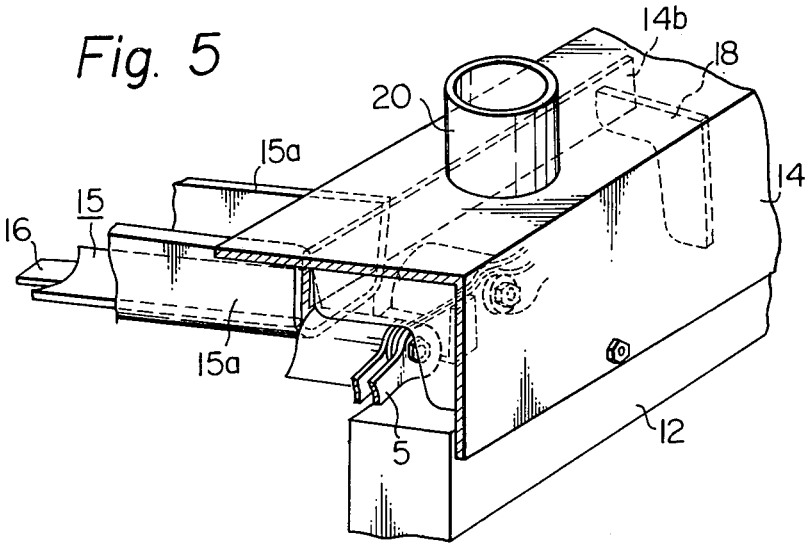
FIG. 5 is a perspective view, partly in section, of a part of the cleaning device shown in FIGS. 2 and 3.
Figure 4:
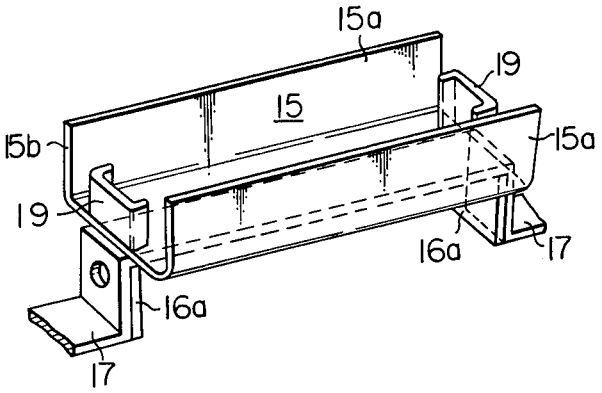
FIG. 4 is a perspective view of a resilient sealing member utilized for the cleaning device shown in FIGS. 2 and 3.
Figure 6:
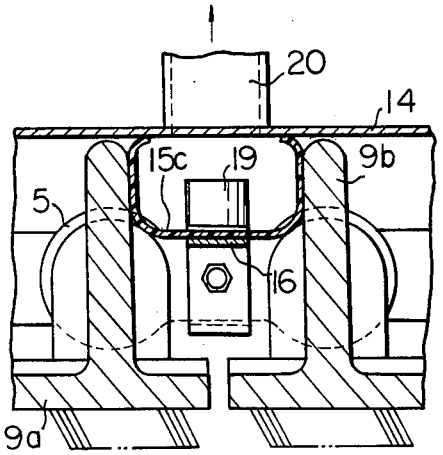
FIG. 6 is a sectional view of a part of the cleaning device shown in FIGS. 2 and 3.
Figure 7:
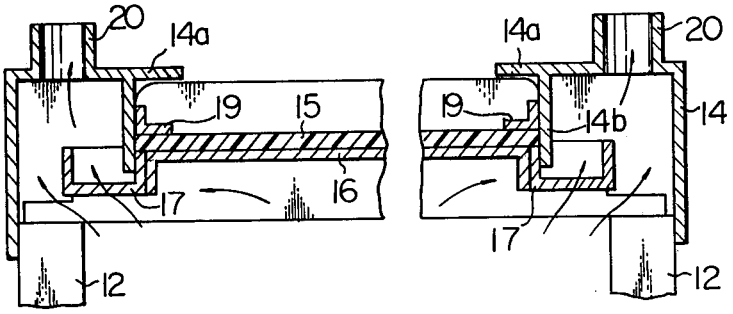
FIG. 7 is a schematic sectional view of the duct of the cleaning device, taken along the longitudinal direction of a flat bar, shown in FIG. 2, for showing the air discharge condition.
Figure 8:
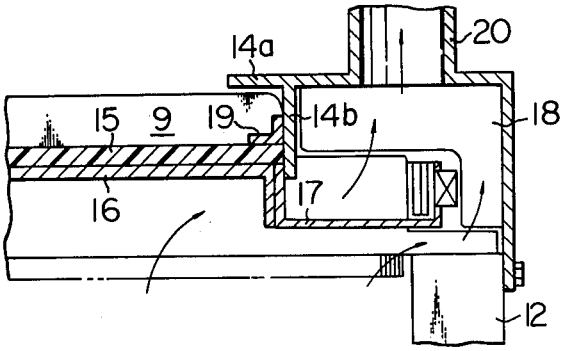
FIG. 8 is a schematic sectional view of the duct of the cleaning device, which is similar to FIG. 7, but is provided with a separation plate.

The resilient member 15 is provided with a pair of free side portions 15*a* which extend along the rotating axis of the main cylinder 2, and the free horizontal edges of these free side portions 15*a* are capable of sliding on an inside surface of the cover plates 14 at the respective inside end portions 14*a* of the cover plates 14 as shown in FIGS. 2 and 3. Each cover plate 14 is provided with an offset plate 14*b* projected downward from the inside surface of the cover plates 14 at the respective inside end portions 14*a* of the cover plate 14 in such a manner that each free end of side surface 15*b* (FIG. 4) of the resilient member 15 is capable of sliding on the inside surface of the corresponding offset plate 14*b*. The free side portions 15*a* of each resilient member 15 contact the ribs 9*b* of two adjacent flat bars 9 as shown in FIG. 2 and consequently, a pair of ducts are formed at the respective positions above the corresponding curved bars 12 as shown in FIGS. 2, 3, 5 and 6. As a result, a space encircled by the flat bars 9, the resilient members 15 and the cover plate 14, which is formed above each curved bar 12, works as a duct for permitting free passage of air flow. Each cover plate 14 is provided with an air discharge pipe 20 which is connected to the above-mentioned duct. Therefore, the fly, that is the short fibers and dust contained in the air stream ejected from each intervening space between two adjacent flat bars 9, can be effectively discharged from the card through the discharge pipes 20 by applying suction force therethrough as shown by FIG. 7. According to our experimental tests, it is also very useful to divide the aforementioned duct by disposing a plurality of separation plates 18 thereinto as shown in FIGS. 2, 5 and 8. In this case, a discharge pipe 20 is arranged for each separated duct.

In the above-mentioned embodiment, to ensure smooth sliding of the two end sides of the resilient members 15 along the inside surface of the offset 14*b* of the cover plate 14, a pair of guide plates 19 are secured to the central portion 15*c* of the resilient member 15 at the two free edge portions thereof as shown in FIGS. 2, 3, 5, 6 and 8.

Figure 9:
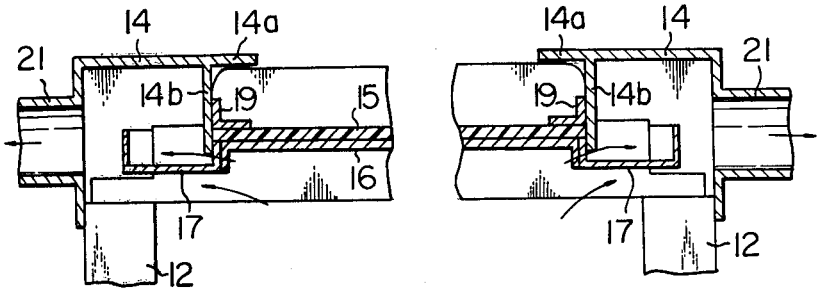
FIGS. 9 and 10 are schematic sectional views of the duct of the cleaning device, provided with modified discharge pipes, according to the present invention.
Figure 10:
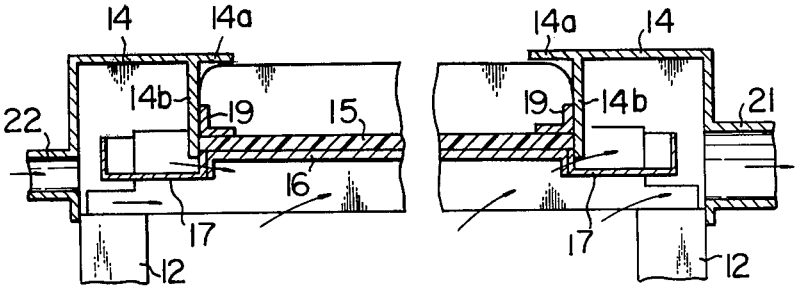
Figure 11:
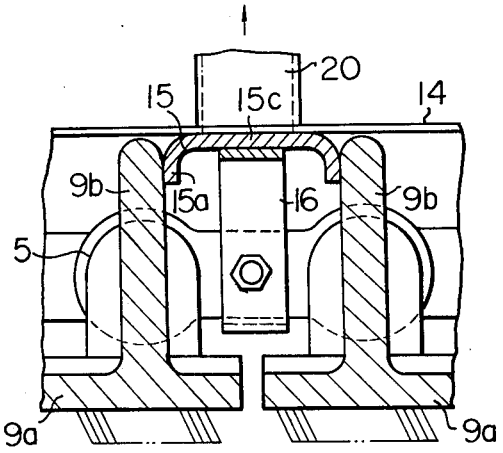
FIGS. 11 and 12 are schematic sectional side views of a part of the modified cleaning devices according to the present invention.
Figure 12:
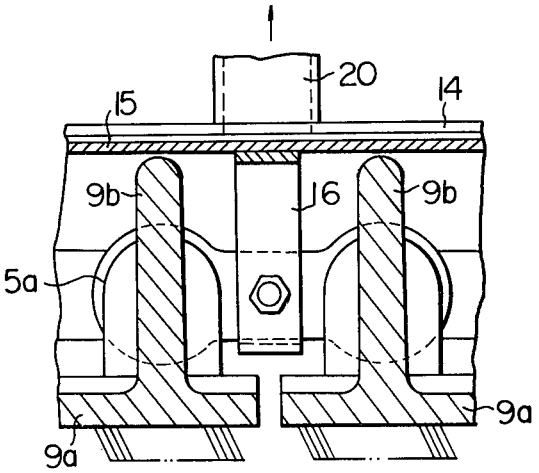

Several modifications can be applied to the above-mentioned device in the spirit of the present invention. That is, instead of discharging the short fibers and dust, contained in the air stream ejected from each space between two adjacent flat bars 9, through the discharge pipes 20 disposed above the cover plate 14, a plurality of discharge pipes 21 can be mounted to the respective cover plates 14 at the side frame thereof as shown in FIG. 9. In the embodiment shown in FIG. 10, one of the pipes 21 of the embodiment shown in FIG. 9, is utilized as an additional air supply conduit 22. It was confirmed that the above-mentioned two modifications also provide an effect similar to the first embodiment shown in FIGS. 1 through 7. In the modification of the first embodiment of the present invention, which is shown in FIG. 11, the resilient sealing member 15 is slidably contacted with the cover plate 14 in such a way that the central portion 15*c* slides on the inside surface of the cover plate 15, while free side portions 15*a* contact the ribs 9*b* of two adjacent flat bars 9. In the embodiment shown in FIG. 12, the resilient sealing member 15 is positioned between the cover plate 14 and the top edge of the rib 9*b* of more than two successive flat bars 9, and this sealing member 15 is rigidly held by one of the link members 5*a*, by way of supporting member 16, which connect these flat bars 9. In such condition, the resilient sealing member 15 slides on the inside surface of the cover plate 14 together with the displacing motion of these flat bars 9. It was confirmed that such modifications of the resilient sealing member 15 also satisfy the purpose of the present invention.

According to our experimental tests, the following preferable features of the present invention were confirmed. That is, since fly, such as short fibers and dust contained in the air stream ejected from the spaces between each two adjacent flat bars, is discharged from the discharge pipes by way of the above-mentioned ducts formed on the respective curved bars, the construction of the cleaning device of the invention is very simple. It is also practically possible to utilize a central discharge system provided with a suction device and the above-mentioned discharge pipes of a plurality of cards are connected to the suction device. It was also confirmed that if the above-mentioned duct is separated by the separation plates 18 as shown in FIG. 2, and such separated ducts are formed at a position adjacent to the terminal positions of the working passage of the flat to the main cylinder 2, the most effective cleaning action can be expected. Since the resilient sealing member 15 is rigidly held by the link member 5 by way of the horizontal supporting member 16, operations for changing flats and for grinding the carding wires of the flats, can be carried out without separating the resilient sealing member 15 from the link member 5. Consequently, the cleaning device according to the present invention does not disturb the above-mentioned traditional maintenance operations.

What is claimed is:

1. A cleaning device for preventing discharge of short fibers and dust from a revolving flat card into the atmosphere of the carding room by an air stream emerging from spaces between adjacent ones of a plurality of flat bars, said flat bars being carried by a pair of spaced link chains revolving at positions above the cylindrical working surface of a main cylinder of said card, so that said flat bars move through a working path having a portion adjacent said cylindrical working surface, each of the link chains being provided with a plurality of link members, a pair of curved bars mounted on corresponding side frames of said card so that each flat bar slides on a corresponding curved bar at both end portions thereof, said cleaning device comprising cover plates rigidly held by each of said curved bars in such a manner that said cover plates define curved spaces along the path of movement of the end portions of the flat bars adjacent said cylindrical working surface, resilient sealing members rigidly held by said link members in such a manner that said resilient sealing members seal open spaces between adjacent flat bars, said cover plates, offset portions thereof, and part of said revolving card cooperating to form corresponding ducts, said resilient sealing members and said flat bars cooperating to form conduits communicating with said ducts, and discharge pipes connected to said ducts whereby said short fibers and dust in the air stream emerging from said conduits between adjacent flat bars to said ducts are discharged from said card through said discharge pipes.

2. The device according to claim 1, wherein each of said resilient sealing members is rigidly mounted on a corresponding link member of said pair of link chains, each said resilient sealing member having two side portions urged against the ribs of the corresponding adjacent flat bars between which said resilient sealing member is disposed, said side portions of each resilient sealing member having top ends slidably engaging the corresponding cover plate at positions above the corresponding curved bar.

3. The device according to claim 2, wherein each said cover plate is provided with a downwardly projecting offset plate, said resilient sealing members moving along said working path of said flat bars with the end surfaces thereof in sliding engagement with inside surfaces of corresponding ones of said offset plates.

4. The device according to claim 2, wherein each of said resilient sealing members is provided with a main portion secured to a corresponding link member, both end portions of said main portion slidably engaging the corresponding cover plates.

5. The device according to claim 1, wherein said duct formed above each curved bar is divided into a plurality of duct sections by means of a plurality of separation plates, said plates being secured to said covers and extending toward said curved bars in planes parallel to said flat bars, at least one said discharge pipe being connected to each of said duct sections.

6. A cleaning device for preventing discharge of short fibers and dust from a revolving flat card into the atmosphere of the carding room by an air stream emerging from spaces between adjacent ones of a plurality of flat bars, said flat bars being carried by a pair of spaced link chains revolving at positions above the cylindrical working surface of a main cylinder of said card, so that said flat bars move through a working path having a portion adjacent said cylindrical working surface, each of the link chains being provided with a plurality of link members, a pair of curved bars mounted on corresponding side frames of said card so that each flat bar slides on a corresponding curved bar at both end portions thereof, said cleaning device comprising cover plates rigidly held by each of said curved bars in such a manner that said cover plates define curved spaces along the path of movement of the end portions of the flat bars adjacent said cylindrical working surface, a unitary resilient sealing member rigidly held by at least one of said link members corresponding to a group of flat bars, in such a manner that said resilient sealing member seals open spaces between adjacent flat bars, said sealing member being movable along the inside surface of corresponding cover, plates in sliding engagement therewith, said cover plates offset portions thereof, and part of said revolving card cooperating to form corresponding ducts, said resilient sealing member and said flat bars cooperating to form conduits communicating with said ducts and discharge pipes connected to said ducts whereby said short fibers and dust in the air stream emerging from said conduits between adjacent flat bars to said ducts are discharged from said card through said discharge pipes.

7. A cleaning device for preventing discharge of short fibers and dust from a revolving flat card into the atmosphere of the carding room by an air stream emerging from spaces between adjacent ones of a plurality of flat bars, said flat bars being carried by a pair of spaced link chains revolving at positions above the cylindrical working surface of a main cylinder of said card, so that said flat bars move through a working path having a portion adjacent said cylindrical working surface, each of the link chains being provided with a plurality of link members, a pair of curved bars mounted on corresponding side frames of said card so that each flat bar slides on a corresponding curved bar at both end portions thereof, said cleaning device comprising cover plates rigidly held by each of said curved bars in such a manner that said cover plates define curved spaces along the path of movement of the end portions of the flat bars adjacent said cylindrical working surface, resilient sealing members rigidly held by said link members in such a manner that said resilient sealing members seal open spaces between adjacent flat bars, said cover plates, offset portions thereof, and part of said revolving card cooperating to form corresponding ducts, said resilient sealing members and said flat bars cooperating to form conduits having first ends communicating with one of said ducts and second ends communicating with another of said ducts, at least one inlet pipe connected to at least one duct at said first ends of said conduits and at least one discharge pipe connected to at least one duct at said second ends thereof, whereby said short fibers and dust in the air stream emerging from said second ends of said conduits between adjacent flat bars are discharged from said card through said discharge pipe.

* * * * *

UNITED STATES PATENT OFFICE

CERTIFICATE OF CORRECTION

Patent No. 4,075,732 Dated February 28, 1978

Inventor(s) Hidejiro Araki, et al

It is certified that error appears in the above-identified patent and that said Letters Patent are hereby corrected as shown below:

In the Abstract, line 7: Cancel "to".

Column 1, line 40: "on back" should be --on a back--.

line 52: Cancel "to".

line 63: "fromm" should be --from--.

Column 2, line 30: "provided" should be --in cooperation--.

line 34: "aid" should be --air--.

line 41: "aformentioned" should be --aforementioned--.

Column 6, line 54: Delete the comma between "cover" and "plates".

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*